United States Patent [19]

Kulak

[11] 4,053,159

[45] Oct. 11, 1977

[54] METHOD FOR FRAMING A JIG-SAW PUZZLE

[76] Inventor: Walter J. Kulak, 5808 N. Winthrop, Chicago, Ill. 60660

[21] Appl. No.: 683,871

[22] Filed: May 6, 1976

[51] Int. Cl.[2] ..... A63F 9/10

[52] U.S. Cl. ..... 273/157 R; 40/152; 156/293

[58] Field of Search ..... 273/157 R; 40/152, 156; 156/293

[56] References Cited

U.S. PATENT DOCUMENTS

| | | | |
|---|---|---|---|
| 2,954,616 | 10/1960 | Mogard | 273/157 R X |
| 3,438,141 | 4/1969 | Kirksey | 273/157 R X |
| 3,550,945 | 12/1970 | Resnick | 273/157 R |
| 3,606,338 | 9/1971 | Cannata | 40/156 |

FOREIGN PATENT DOCUMENTS

| | | | |
|---|---|---|---|
| 216,842 | 8/1958 | Australia | 273/157 R |

*Primary Examiner*—Anton O. Oechsle
*Attorney, Agent, or Firm*—Bernard L. Kleinke

[57] ABSTRACT

A method and apparatus for framing a jig-saw puzzle includes providing a combination work assembly board and frame having a raised peripheral rim and a bottom wall defining a well therewithin for receiving the completed jig-saw puzzle, and attaching the completed puzzle to the frame. In one embodiment of the present invention, a backing sheet is placed in the well of the frame in overlying relationship with the bottom wall-,and the jig-saw puzzle is assembled in the frame on top of the upper surface of the backing sheet. The completed jig-saw puzzle is then removed from the frame on top of the backing sheet so that an adhesive may be applied to the bottom wall of the frame. A slide board is then placed on top of the rim of the frame, and the completed puzzle and the backing sheet are placed on top of the slide board. The slide board and the backing sheet are then slipped out from under the completed puzzle which then drops into the well of the frame into engagement with the adhesive coated bottom wall thereof to affix the completed puzzle to the frame. In another embodiment of the present invention, a combination work assembly board and frame is provided and has a raised peripheral rim and a bottom wall defining a well therewithin for receiving the completed jig-saw puzzle, and a backing sheet is placed in the well in overlying relationship with the bottom wall so that the jig-saw puzzle can be assembled in the frame on top of the backing sheet. The front face of the completed jig-saw puzzle is then coated with an adhesive, and the adhesive coating is then permitted to cure. The backing sheet is then lifted out of the well to remove the coated puzzle therefrom. The rear face of the puzzle is then attached to the frame within the well.

6 Claims, 9 Drawing Figures

11
14
12
22
18
20
10

16

18
22
24
12

16
18
12

14
16
12
11
20
24
18
12

24
20
11
18
12

31
37
41
39
43
35
28
33

43
41
33
35
37
31
39

43
41
33

METHOD FOR FRAMING A JIG-SAW PUZZLE

The present invention relates in general to a method for framing a jig-saw puzzle, and it more particularly relates to a method which enables a completed jig-saw puzzle to be attached at its rear face to a frame.

Jig-saw puzzles are a popular pastime, and it has been desired to have a convenient technique for mounting a completed jig-saw puzzle to a frame. In this regard, the completed jig-saw puzzle may be preserved and used as a wall hanging or as a serving tray. For example, reference may be made to the following U.S. Pat. Nos. 2,011,058; 2,825,568; 3,550,945 and 3,606,338. As shown and described in at least some of these patents, techniques are known for securing the back or rear face of a completed jig-saw puzzle to a frame. In U.S. Pat. No. 3,606,338, the puzzle is secured to a frame by completing the puzzle in the bottom of a two-part box, and then a sheet is placed on top of the completed puzzle. The bottom of the box is then placed over the top of the box containing the puzzle and the sheet. The whole unit is then turned upside down, and both the top and the bottom of the box are removed. Adhesive is then applied to the inside of the bottom of the box, and the adhesive coated inside surface of the bottom of the box is placed into engagement with the rear face of the upside down puzzle to secure the puzzle to the bottom of the box. While such a technique may be satisfactory for some applications, the use of the puzzle box as a frame is not very desirable. In this regard, once the completed jig-saw puzzle is placed into the adhesive coated bottom portion of the box, the puzzle must be smoothed out so that it will lie flat. In so doing, the puzzle tends to spread out, and thus the flimsy cardboard walls of conventional puzzle boxes would not serve to provide adequate support for retaining the completed puzzle within a well defined boundary. Thus, it would be highly desirable to have a method for mounting a completed jig-saw puzzle in a simple but efficient manner.

Therefore, the principal object of the present invention is to provide a new and improved method of mounting a completed jig-saw puzzle in a simple and efficient manner.

Another object of the present invention is to provide such a new and improved method of mounting a jig-saw puzzle, which method being relatively inexpensive and being easy to practice.

Briefly, the above and further objects are realized by providing a kit and method of mounting a jig-saw puzzle, wherein in one embodiment of the present invention a combination work assembly board and frame is provided and has a raised peripheral rim defining a well therewithin for receiving the completed jig-saw puzzle. A backing sheet is placed in overlying engagement with the frame within the well, and the jig-saw puzzle is assembled on the sheet. The front face of the completed jig-saw puzzle is coated with an adhesive, and the adhesive is permitted to cure. The backing sheet is then lifted out of the well to remove the coated puzzle therefrom, and the rear face of the puzzle is then attached to the frame within the well. In accordance with another aspect of the present invention, a kit is provided for mounting the completed jig-saw puzzle, and the kit includes a combination work assembly board and frame having a raised peripheral rim and a bottom wall defining a well therewithin for receiving the completed jig-saw puzzle. A backing sheet is placed in the well in overlying relationship with the bottom wall of the frame. The jig-saw puzzle is assembled in the frame on top of the upper surface of the backing sheet, and then the backing sheet is removed with the assembled puzzle resting on the upper surface thereof from the well of the frame. A slide board is placed on top of the rim in overlying relationship therewith. The backing sheet is then placed with the assembled puzzle disposed on the upper surface thereof on top of the upper surface of the slide board, and the slide board and the backing sheet are slid along the rim and out from under the assembled puzzle to permit it to drop into the well into engagement with the prepared bottom wall.

For other features and advantages of the present invention and for a more complete understanding of the objects and features of the invention, reference may be made to the following detailed description, taken in connection with the accompanying drawings, wherein.

Figures 1, 2, 3, 4, 5, 6, 7, 8, 9:
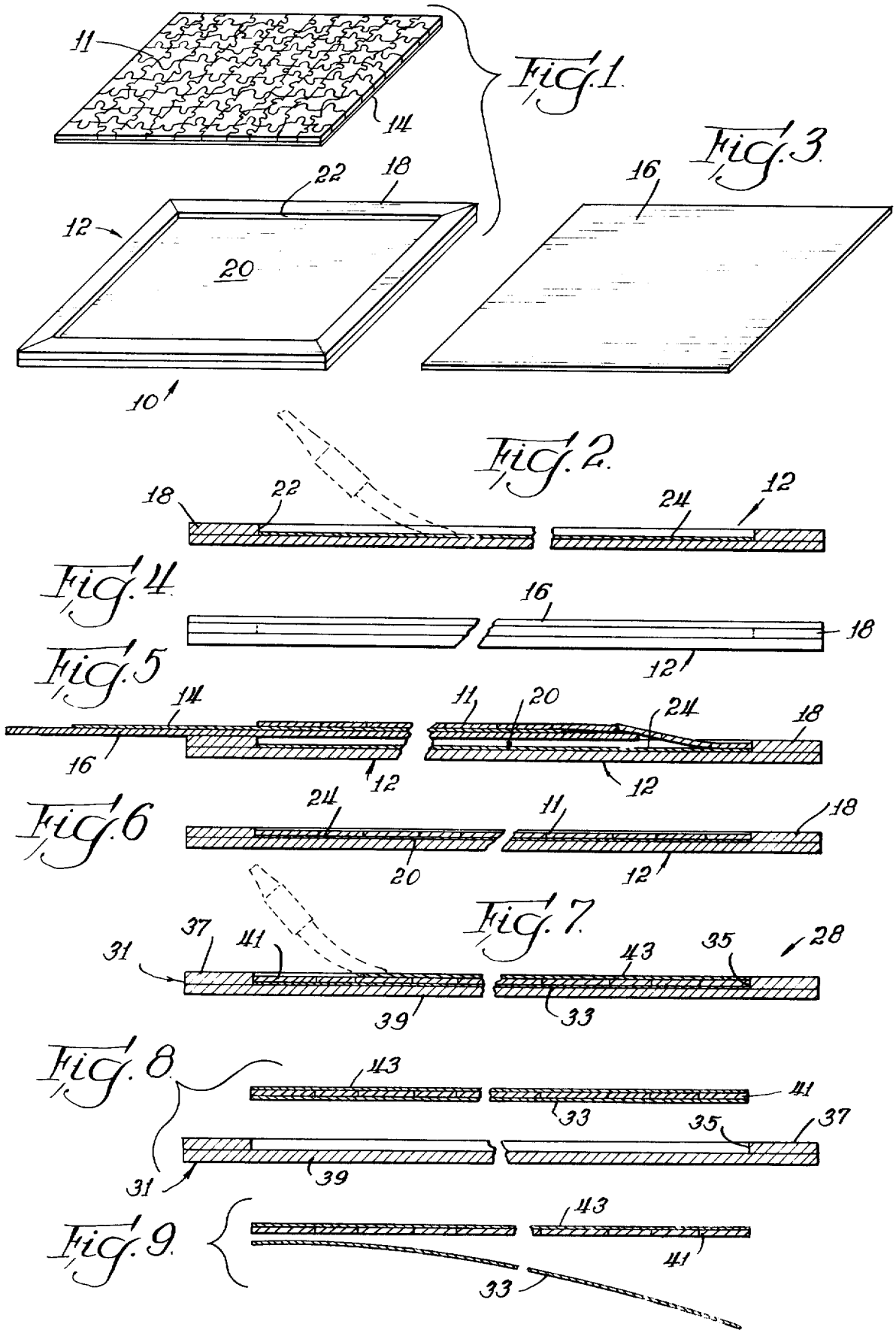
FIG. 1 is a pictorial view of a portion of a puzzle mounting kit constructed in accordance with the present invention.
FIG. 2 is a cross-sectional fragmentary view of the work assembly board and frame of the kit of FIG. 1 illustrating a step of the method according to the present invention.
FIG. 3 is a pictorial view of a slide board of the kit of FIG. 1.
FIG. 4 is a fragmentary elevational view of the kit of FIG. 1 during a successive step of the method according to the present invention.
FIG. 5 is a cross-sectional fragmentary view of the kit of FIG. 1 showing a successive step of the method according to the present invention.
FIG. 6 is a cross-sectional fragmentary view of the kit of FIG. 1 showing the final step of the method according to the present invention.
FIG. 7 is a kit which is also constructed in accordance with the present invention and which shows an initial step in accordance with the method of the present invention.
FIG. 8 is a cross-sectional fragmentary view of the kit of FIG. 7 showing a successive step in the method according to the present invention.
FIG. 9 is a cross-sectional fragmentary view of the kit of FIG. 7 showing a successive step in the method according to the present invention.

Referring now to the drawings, and more particularly to FIGS. 1, 2, 3, 4, 5 and 6 thereof, there is shown a kit 10 for mounting a jig-saw puzzle 11, the kit being constructed in accordance with the present invention. The kit includes a work assembly board and frame 12 for receiving the jig-saw puzzle 11, whereby the frame 12 serves both as a work assembly board to enable the user to complete the puzzle on the frame 12 and as a frame for the completed puzzle 11 so that the rear face of the puzzle 11 may be affixed to the frame 12 in accordance with the present invention as hereinafter described in greater detail. A flexible backing sheet 14 is of a similar size as the size of the puzzle 11 and is adapted to be positioned in underlying relationship with the puzzle 11 so that it can be raised out of the frame 12 as hereinafter described in greater detail. A larger rigid sheet or slide board 16 is adapted to rest on top of a raised rim 18 of the frame 12 as shown in FIG. 4 of the drawings to facilitate the proper positioning of the puzzle during the mounting operation as hereinafter described in greater detail. A flat rear wall 20 of the frame 12 cooperates with the raised rim 18 to define a well 22 which receives the puzzle 11 and the backing sheet 14 therewithin.

In use, the work assembly board and frame 12 has the backing sheet 14 disposed within the well 22 in overlying relationship with the rear wall 20. The puzzle 11 may then be assembled within the well 22 so that the frame 12 facilitates the assembly of the puzzle 11. If it should be desired to affix the completed puzzle 11 to the frame 12, the backing sheet 14 with the completed puzzle 11 resting thereon is lifted out of the well 22 of the frame 12. A suitable adhesive is then brushed onto the wall 20 of the frame 12 to form a coating 24 as shown in FIG. 2 of the drawings. Thereafter, the slide board 16 is then placed on top of the raised rim 18 of the frame 12 as shown in FIG. 4, and as shown in FIG. 5 of the drawings, the backing sheet 14 with the completed puzzle 11 resting thereon is then placed on top of the slide board 16. The slide board 16 and the backing sheet 14 are then slid along the upper surface of the raised rim 18 out from under the completed puzzle 11, which then is permitted to drop under the force of gravity into the well 22 into engagement with the adhesive coating 24. The coating 24 is then permitted to dry, and the puzzle 11 is then fixed in position within the frame 12 as shown in FIG. 6 of the drawings.

Considering now the work assembly board and frame 12 in greater detail with reference to the drawings, the frame 12 is rigid in construction and may be composed of any suitable material, such as fiberboard. The frame 12 is generally rectangular in shape as illustrated in the drawings, but is is to be understood by those skilled in the art that other shapes may be employed.

The rim 18 is a raised border which extends upwardly from the rear wall 20. The rim is composed of four separate pieces which are joined together at mitred corners, but it is to be understood that the rim 18 may also be constructed of a single one-piece unit. The outer edges of the rim 18 are flush with the outer edges of the rear wall 20, and the inner edges of the rim 18 cooperating with the rear wall 20 to form the well 22 abut the peripheral edges of the puzzle 11 and the backing sheet 14 when they are disposed within the well 22. The rim 18 may be attached to the rear wall 20 by any suitable technique, such as by affixing the rim 18 to the rear wall 20 by means of a suitable adhesive.

The rigid construction of the rim 18 and the rear wall 20 enables the completed puzzle to be dropped into engagement with the adhesive coating 24 and then be spread out against the rigid rim 18 so that the puzzle 11 can be smoothed by the fingers of the user into a flat disposition with the side edges of the puzzle 11 engaging the rim 18.

Considering now the slide board 16, the board 16 is generally rectangular in shape so that when it overlies the top edges of the rim 18, the outer peripheral edges of the slide board 16 are flush with the side edges of the rim 18 as shown in FIG. 4 of the drawings. The slide board 16 may be composed of any suitable rigid material, such as fiberboard.

The size of the slide board 16 should be sufficient to enable it to rest on top of the rim 18 and slide therealong to deposit the completed puzzle 11 into the well 22. The slide board 16 can also serve as a cover for the frame 12 when the puzzle 11 is in a partial state of completion for storage purposes. While the slide board 16 may be composed of fiberboard material, other rigid materials may also be employed, such, for example, as a heavy cardboard stock.

Considering now the adhesive coating 24, the coating 24 may be of any suitable adhesive material, which does not dry too quickly so as to enable the user to position the completed puzzle into engagement with the adhesive coat and then permit the user to flatten out the completed puzzle and spread it apart slightly so as to engage the rim 18. One type of adhesive material which has been found to be satisfactory is a water base varnish, such as a high gloss water base varnish sold by Sherwin Williams Company, or a satin finish water base varnish sold by Pittsburgh Paint Company. Such a varnish can also be used to coat the front face of the puzzle 11 once it is secured to the frame 12 for providing a protective coating. In this regard, the protective coating on the front face of the puzzle enables the completed puzzle affixed to the frame 12 to enable the unit to be a serving tray or a wall hanging.

By utilizing the method and apparatus of the present invention, the puzzle 11 can be quickly and easily affixed to the frame 12 in a ready and convenient manner. In this regard, there is no need to turn the completed jig-saw puzzle upside down before applying an adhesive coating to affix the back side of the puzzle to the frame as in prior art methods. Turning the completed puzzle upside down is a difficult and awkward manipulation which is totally eliminated by the method and apparatus of the present invention.

It should be understood that various different shapes of wells may be provided, and it should be understood that it is not necessary to have the inside configuration of the well 22 to complement the outer configuration of the puzzle. For example, a puzzle having a circular plan view could be used in connection with a square-shaped work assembly board and frame to provide an aesthetically pleasing appearance. In this regard, the circular puzzle would engage the rim at only four separate points.

By employing a fiberboard material for the frame 12, the frame 12 does not tend to warp by absorbing moisture. Therefore, the puzzle will remain in a flat position indefinitely once it is mounted to the fiberboard frame 12.

The backing sheet 14 may be composed of paper material. The backing sheet 14 preferably has a light color, such as white, on the front face thereof to facilitate the assembly of the puzzle thereon. The rear face of the backing sheet 14 may have instructions or advertising material printed thereon.

Referring now to FIGS. 7, 8 and 9 of the drawings, there is shown a kit 28, which is constructed in accordance with the present invention. The kit 28 includes a work assembly board and frame 31, which is similar to the frame 12 of FIG. 1, and a backing sheet 33 disposed within a well 35 in the frame 31 in a similar manner as the backing sheet 14 fits within the well 22 of the kit 10 shown in FIG. 1. The frame 31 includes a raised rim 37 having a rear wall 39, which together with the rim 37 define the well 35 in a similar manner as the raised rim 18 and the rear wall 20 of the frame 12 of FIG. 1. A jig-saw puzzle 14 may be assembled in the well 39 of the frame 31 and it may be affixed therewithin according to the present invention.

In use, in order to affix the puzzle 41 to the frame 31, the backing sheet 33 is placed in overlying relationship on the rear wall 39 within the well 35. The puzzle 41 to be framed is then assembled within the well 35 on top of the backing sheet 33.

After completing the puzzle 41, a clear adhesive coating 43 is then applied to the front face of the puzzle 41 by brushing the clear adhesive thereon without touching the rim 37. The adhesive coating 43 is then cured by permitting it to dry.

As shown in FIG. 8 of the drawings, the puzzle 41 with the cured coating 43 on the front face thereof may then be lifted out of the well 35 of the frame 31 in a one-piece manner, since the cured coating 43 holds the puzzle 41 intact.

The backing sheet 33 prevents any adhesive from seeping between the puzzle pieces and into engagement with the back wall 39, thereby making it difficult to remove the entire puzzle 41 in a one-piece manner.

After the puzzle 43 is removed from the frame 31, the backing sheet 33 may be peeled off from the back face of the puzzle 41 since some of the adhesive seeping between the puzzle pieces oftentimes affixes the backing sheet 33 to the puzzle 41.

After removing the backing sheet 33 from the puzzle 41, an adhesive coating may be applied to the bottom wall 39 within the well 35 in a manner as shown in FIG. 2 in connection with the kit 10. The puzzle 43 may then be placed into the well 35 of the frame 31 to secure it in place as shown in FIG. 6 of the drawings in connection with the kit 10.

The adhesive for the coating 43 may be any suitable adhesive, such as the adhesive referred to as the "Improved Liquid Jig-saw Puzzle Saver" by Milton Bradley Company of Springfield, Mass. Such an adhesive should be clear and it should remain tacky sufficiently long to attach the puzzle 41 to the frame 31.

While the present invention has been described in connection with particular embodiments thereof, it will be understood that many changes and modifications of this invention may be made by those skilled in the art without departing from the true spirit and scope thereof. For example, other types and kinds of materials may be used for the work assembly board and frame, such materials including plastic materials. Also, while an interlocking jig-saw puzzle has been illustrated in the drawings non-interlocking jig-saw puzzles may also be used in connection with the method and apparatus of the present invention. Accordingly, the appended claims are intended to cover all such changes and modifications as fall within the true spirit and scope of the present invention.

What is claimed is:

1. A method of framing a completed jig-saw puzzle, comprising:

providing a combination work assembly board and frame having a raised peripheral rim and a bottom wall defining a well therewithin for receiving the completed jig-saw puzzle;

providing a backing sheet;

placing loosely and freely said backing sheet in the well in overlying relationship with the bottom wall;

assembling the jig-saw puzzle to be framed in the frame on top of the upper surface of the backing sheet with the front face of the puzzle facing upwardly and the rear face thereof overlying said upper surface of said backing sheet;

removing the backing sheet with the assembled puzzle resting on the upper surface thereof from the well of the frame;

preparing the bottom wall with an adhesive material;

providing a slide board and placing it on top of the rim in overlying relationship therewith;

placing the backing sheet with the assembled upwardly facing puzzle disposed on the upper surface thereof on top of the upper surface of the slide board; and sliding the backing sheet and the slide board along the rim and out from under the assembled puzzle to permit it to drop under the force of gravity into the well with the rear face of the puzzle moving into engagement with the prepared bottom wall.

2. A method according to claim 1, wherein said preparing the bottom wall with an adhesive material includes brushing the adhesive material onto the face of the bottom wall.

3. A method according to claim 1, wherein as the backing sheet and slide board are being slid along the rim, pressing downwardly on the completed puzzle and guiding said puzzle over the trailing edges of the backing sheet and slide board into said well, subsequently positioning said puzzle in a flat manner within said well.

4. A method according to claim 3, flattening out said puzzle in said well and moving the peripheral edges of said puzzle into engagement with the rim.

5. A method of framing a completed jig-saw puzzle, comprising:

providing a combination work assembly board and frame having a raised peripheral rim defining a well therewithin for receiving the completed jig-saw puzzle;

providing a backing sheet and placing it in overlying engagement with said frame within said well;

assembling the jig-saw puzzle in said frame on said sheet;

coating the front face of the completed jig-saw puzzle in said frame with an adhesive;

permitting the coated puzzle to cure;

lifting the backing sheet out of said well to remove the coated puzzle therefrom; and attaching the rear face of the puzzle to said frame within said well.

6. A method according to claim 5, prior to attaching the puzzle to said frame, removing said backing sheet from the coated puzzle and applying an adhesive to the bottom wall of the well of the frame.

* * * * *